US008197298B2

(12) United States Patent
Willett

(10) Patent No.: US 8,197,298 B2
(45) **Date of Patent: *Jun. 12, 2012**

(54) TRANSFORMABLE TOY VEHICLE

(75) Inventor: William Willett, Irvine, CA (US)

(73) Assignee: Mattel, Inc., El Segundo, CA (US)

( * ) Notice: Subject to any disclaimer, the term of this patent is extended or adjusted under 35 U.S.C. 154(b) by 427 days.

This patent is subject to a terminal disclaimer.

(21) Appl. No.: 12/263,882

(22) Filed: Nov. 3, 2008

(65) Prior Publication Data

US 2009/0124164 A1 May 14, 2009

Related U.S. Application Data

(63) Continuation of application No. PCT/US2007/010909, filed on May 4, 2007.

(60) Provisional application No. 60/797,790, filed on May 4, 2006, provisional application No. 60/915,715, filed on May 3, 2007.

(51) Int. Cl.
*A63H 23/04* (2006.01)
*A63H 17/00* (2006.01)
*A63H 17/267* (2006.01)

(52) U.S. Cl. ..... 446/164; 446/462; 446/465; 446/470

(58) Field of Classification Search ..... 446/153, 446/154, 160, 164, 456, 462, 465, 470
See application file for complete search history.

(56) References Cited

U.S. PATENT DOCUMENTS

| | | | |
|---|---|---|---|
| 1,871,297 | A | 8/1932 | Berger |
| 2,104,636 | A | 1/1938 | Burcham |
| 2,372,043 | A | 3/1945 | Aghnides |
| 2,949,697 | A | 8/1960 | Licitis et al. |
| 3,226,878 | A | 1/1966 | Glass et al. |
| 3,312,013 | A | 4/1967 | Graves |
| 3,327,796 | A | 6/1967 | Hanmer |
| 3,500,579 | A | 3/1970 | Bryer |
| 3,555,725 | A | 1/1971 | Orfei et al. |
| 3,667,156 | A | 6/1972 | Tomiyama et al. |
| 3,722,134 | A | 3/1973 | Merrill et al. |

(Continued)

FOREIGN PATENT DOCUMENTS

DE 88033082 6/1988

(Continued)

OTHER PUBLICATIONS

Mattel, *Mattel 1996* Catalog, p. 123.

(Continued)

*Primary Examiner* — John Ricci
(74) *Attorney, Agent, or Firm* — Panitch Schwarze Belisario & Nadel LLP

(57) ABSTRACT

A toy vehicle includes a central housing having first and second oppositely disposed sides. A first wheel is rotatably mounted on the first side of the housing and a second wheel is rotatably mounted on the second side of the housing. Each of the first and second wheels has a central hub. Each hub has a center disposed along a common first axis of rotation. A plurality of vanes are attached to the hub and form the first and second wheels. An end of each vane distal to the hub forms a circumferential surface portion of one of the first and second wheels. Each vane is individually and separately manually angularly repositionable about a second axis of rotation extending transversely with respect to the first axis of rotation.

17 Claims, 9 Drawing Sheets

U.S. PATENT DOCUMENTS

| | | | |
|---|---|---|---|
| 3,733,739 | A | 5/1973 | Terzian |
| 3,746,117 | A | 7/1973 | Alred |
| 3,798,835 | A | 3/1974 | McKeehan |
| 3,893,707 | A | 7/1975 | Samsel |
| 4,057,929 | A | 11/1977 | Ogawa |
| 4,143,484 | A | 3/1979 | Yonezawa |
| 4,173,096 | A | 11/1979 | Meyer et al. |
| 4,300,308 | A | 11/1981 | Ikeda |
| D262,224 | S | 12/1981 | Aoki |
| 4,310,987 | A | 1/1982 | Chieffo |
| 4,386,787 | A | 6/1983 | Maplethorpe et al. |
| 4,391,224 | A | 7/1983 | Adler |
| 4,438,588 | A | 3/1984 | Martin |
| 4,471,567 | A | 9/1984 | Martin |
| 4,501,569 | A | 2/1985 | Clark, Jr. et al. |
| 4,505,346 | A | 3/1985 | Mueller |
| 4,541,814 | A | 9/1985 | Martin |
| 4,547,173 | A | 10/1985 | Jaworski et al. |
| 4,568,306 | A | 2/1986 | Martin |
| 4,599,077 | A | 7/1986 | Vuillard |
| 4,601,519 | A | 7/1986 | D'Andrade |
| 4,601,675 | A | 7/1986 | Robinson |
| 4,609,196 | A | 9/1986 | Bozinovic |
| 4,643,696 | A | 2/1987 | Law |
| 4,648,853 | A | 3/1987 | Siegfried |
| 4,666,420 | A | 5/1987 | Nagano |
| 4,671,779 | A | 6/1987 | Kurosawa |
| 4,674,585 | A | 6/1987 | Barlow et al. |
| 4,680,022 | A | 7/1987 | Hoshino et al. |
| 4,693,696 | A | 9/1987 | Buck |
| 4,698,043 | A | 10/1987 | May et al. |
| 4,726,800 | A | 2/1988 | Kobayashi |
| 4,773,889 | A | 9/1988 | Rosenwinkel et al. |
| 4,892,503 | A | 1/1990 | Kumazawa et al. |
| 4,897,070 | A | 1/1990 | Wagstaff |
| 4,927,401 | A | 5/1990 | Sonesson |
| 5,041,051 | A | 8/1991 | Sonesson |
| 5,102,367 | A | 4/1992 | Mullaney et al. |
| 5,131,882 | A | 7/1992 | Kiyokane |
| 5,171,181 | A | 12/1992 | Freeman |
| 5,228,880 | A | 7/1993 | Meyer et al. |
| 5,267,888 | A | 12/1993 | Hippely et al. |
| 5,439,408 | A | 8/1995 | Wilkinson |
| 5,487,692 | A | 1/1996 | Mowrer et al. |
| 5,533,921 | A | 7/1996 | Wilkinson |
| 5,618,219 | A | 4/1997 | Simone et al. |
| 5,626,506 | A | 5/1997 | Halford et al. |
| 5,667,420 | A | 9/1997 | Menow et al. |
| 5,692,946 | A | 12/1997 | Ku |
| 5,752,871 | A | 5/1998 | Tsuzuki |
| 5,769,441 | A | 6/1998 | Namngani |
| 5,797,815 | A | 8/1998 | Goldman et al. |
| 5,871,386 | A | 2/1999 | Bart et al. |
| 5,919,075 | A | 7/1999 | George et al. |
| 5,921,843 | A | 7/1999 | Skrivan et al. |
| 6,024,627 | A | 2/2000 | Tilbor et al. |
| 6,066,026 | A | 5/2000 | Bart et al. |
| 6,086,026 | A | 7/2000 | Pearce |
| 6,095,890 | A | 8/2000 | George et al. |
| 6,129,607 | A | 10/2000 | Hoeting et al. |
| 6,132,287 | A | 10/2000 | Kuralt et al. |
| 6,227,934 | B1 | 5/2001 | Isaksson et al. |
| 6,264,283 | B1 | 7/2001 | Rehkemper et al. |
| 6,394,876 | B1 | 5/2002 | Ishimoto |
| 6,414,457 | B1 | 7/2002 | Agrawal et al. |
| 6,439,948 | B1 | 8/2002 | Ostendorff et al. |
| 6,458,008 | B1 | 10/2002 | Hyneman |
| 6,461,218 | B1 | 10/2002 | Mullaney et al. |
| 6,475,059 | B1 | 11/2002 | Lee |
| 6,481,513 | B2 | 11/2002 | Buehler et al. |
| 6,502,657 | B2 | 1/2003 | Kerrebrock et al. |
| 6,540,583 | B1 | 4/2003 | Hoeting et al. |
| 6,648,722 | B2 | 11/2003 | Lynders et al. |
| 6,672,934 | B2 | 1/2004 | Hornsby et al. |
| 6,681,150 | B1 | 1/2004 | Haga et al. |
| 6,752,684 | B1 | 6/2004 | Lee |
| 6,764,374 | B2 | 7/2004 | Tilbor et al. |
| 6,860,346 | B2 | 3/2005 | Burt et al. |
| 6,902,464 | B1 | 6/2005 | Lee |
| 6,926,581 | B2 | 8/2005 | Lynders et al. |
| 6,964,309 | B2 | 11/2005 | Quinn et al. |
| 7,017,687 | B1 | 3/2006 | Jacobsen et al. |
| 7,033,241 | B2 | 4/2006 | Lee et al. |
| 7,040,951 | B2 | 5/2006 | Hornsby et al. |
| 7,172,488 | B2 | 2/2007 | Moll et al. |
| 7,217,170 | B2 | 5/2007 | Moll et al. |
| 7,234,992 | B2 | 6/2007 | Weiss et al. |
| 2002/0011368 | A1 | 1/2002 | Berg |
| 2005/0133280 | A1 | 6/2005 | Horchler et al. |

FOREIGN PATENT DOCUMENTS

| | | |
|---|---|---|
| FR | 2539904 | 7/1984 |
| GB | 1292441 | 10/1972 |
| GB | 2194457 | 3/1988 |
| JP | 58167263 | 10/1983 |
| JP | 59167584 | 9/1984 |
| JP | 61139288 | 6/1986 |
| JP | 63269701 A | 11/1988 |
| WO | WO-0224417 | 3/2002 |

OTHER PUBLICATIONS

EP Supplemental Search Report issued on Jun. 28, 2010 in EP Application No. 07776782.

TRANSFORMABLE TOY VEHICLE

CROSS-REFERENCE TO RELATED APPLICATIONS

This patent application claims priority to U.S. Provisional Patent Application No. 60/797,790, filed May 4, 2006, entitled "MINI SHELL SHOCKER RC—Generally Spherical Transforming Toy Vehicle" and to U.S. Provisional Patent Application No. 60/915,715, filed May 3, 2007, entitled "Transformable Toy Vehicle", and is a continuation of International Application No. PCT/US07/10909 filed May 4, 2007 entitled "Transformable Toy Vehicle", the disclosures of which are incorporated by reference herein in their entireties.

BACKGROUND OF THE INVENTION

The present invention relates to toy vehicles, particularly those having unusual transforming characteristics. More specifically, the invention relates to transforming toy vehicles having only two wheels for support and propulsion.

BRIEF SUMMARY OF THE INVENTION

Briefly stated, the present invention is a toy vehicle comprising a central housing having first and second oppositely disposed sides. A first wheel is rotatably mounted on the first side of the housing and a second wheel is rotatably mounted on the second side of the housing. Each of the first and second wheels have a central hub. Each hub has a center disposed along a common first axis of rotation. A plurality of vanes are attached to the hub and form the first and second wheels. An end of each vane distal to the hub forms an outermost circumferential surface portion of one of the first and second wheels most distal to the first axis in all configurations of the first and second wheels. Each vane is individually and separately manually angularly repositionable about a second axis of rotation, each second axis extending from an end of the vane proximal to the hub transversely away from the hub and the first axis.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings an embodiment which is presently preferred. It should be understood, however, that the invention is not limited to the precise arrangements and instrumentalities shown.

In the drawing.

DETAILED DESCRIPTION OF THE INVENTION

Figure 1:
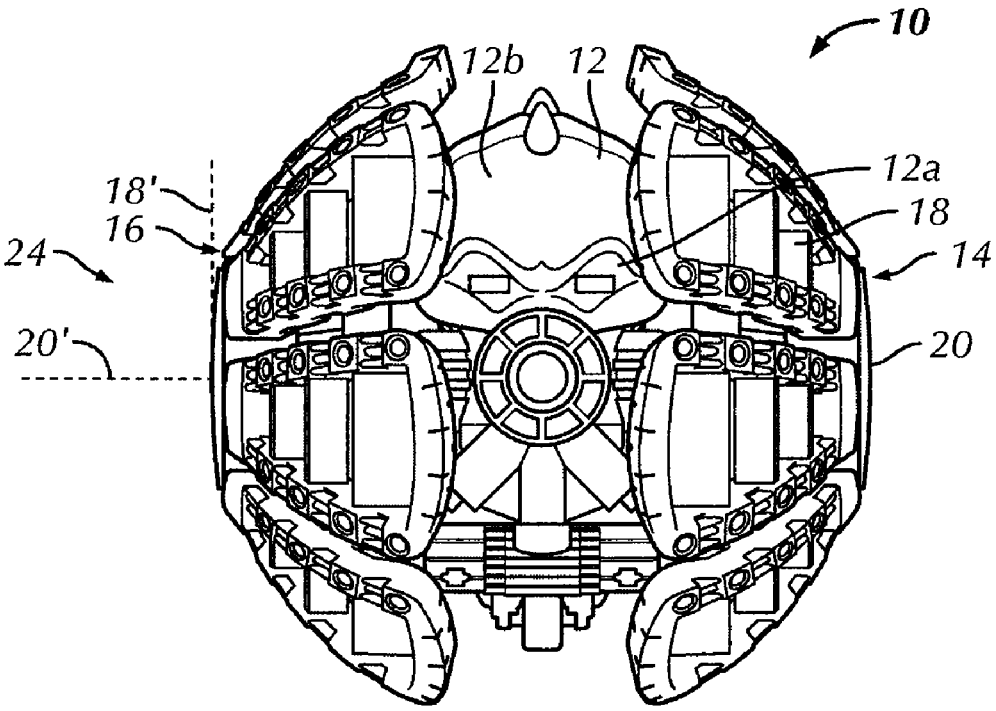
FIG. 1 is a front perspective view of a toy vehicle in accordance with a preferred embodiment of the present invention, the toy vehicle shown with a first configuration.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Referring to the drawings, wherein like numerals indicate like elements throughout, there is shown, in FIGS. 1-15, a preferred embodiment of a generally spherical transforming toy vehicle in accordance with the present invention and indicated at 10. The toy vehicle 10 is intended to have a power source, such as one or more batteries 13 (see FIGS. 10-11), for instance, to power movement of the toy vehicle 10. Furthermore, it is preferred that the toy vehicle 10 have control electronics or an on-board control unit 100 (FIG. 15) within a control electronics housing 11, having a lid 11*a*, and be remotely controlled by a user using a generally conventional remote control device 105 spaced from the toy vehicle 10.

Referring specifically to FIGS. 1-8, the toy vehicle 10 comprises a chassis, which is provided by a central outer housing 12, and first and second hemispheric "wheels" 14 and 16, respectively. Specifically, the outer housing 12 has first and second oppositely disposed sides 12*a*, 12*b*. The first wheel 14 is rotatably mounted on the first side 12*a* of the housing 12 and the second wheel 16 is rotatably mounted on the second side 12*b* of the housing 12. Specifically, each wheel 14, 16 has a central polygonal housing or central hub 20 and is preferably formed by a plurality (seven in the illustrated embodiment) of individual vanes 18 mounted around the circumferential edges or sides of the hub 20. An end of each vane 18 distal to the hub 20 forms a circumferential surface portion of one of the first and second wheels 14, 16. Each central hub 20 has a center generally disposed along a common first axis of rotation 20' that is a common axis of rotation of the two hubs 20. Preferably, each wheel 14, 16 comprises a plurality of identical vanes 18, each mounted to and extending through one of the planar circumferential walls or faces 20*a* of a preferably heptagonally shaped hub 20. Each vane 18 is mounted so as to be able to rotate at least about 180° with respect to the housing 12. Preferably, each vane 18 is rotatable about a second vane axis 18' extending from an end of the vane 18 proximal to the hub 20 transversely away from the hub 20 and the first axis 20', more preferably, extending at least generally radially from the first axis 20'.

Figure 2:
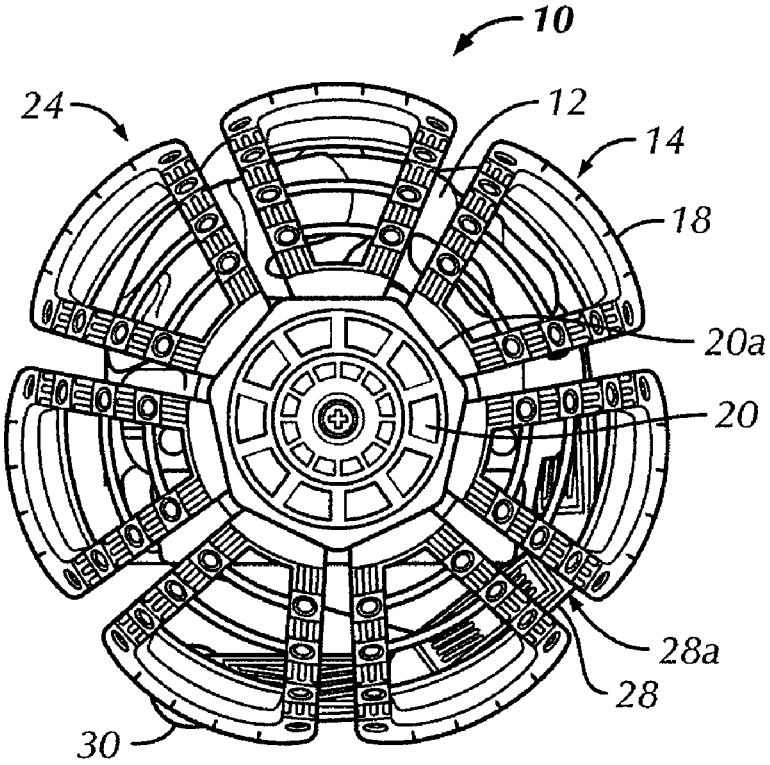
FIG. 2 is a right side perspective view of the toy vehicle of FIG. 1, a tail of the toy vehicle shown in a retracted position.
Figure 3:
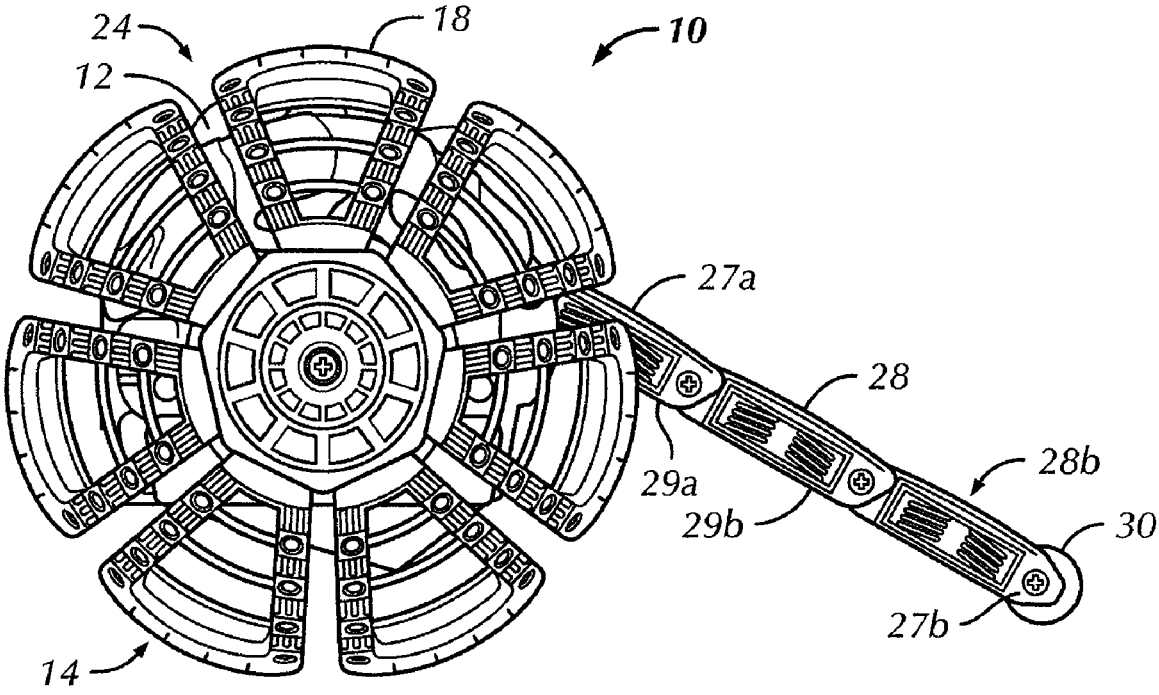
FIG. 3 is a right side perspective view of the toy vehicle of FIG. 1, the tail of the toy vehicle shown in an extended position.
Figure 6:
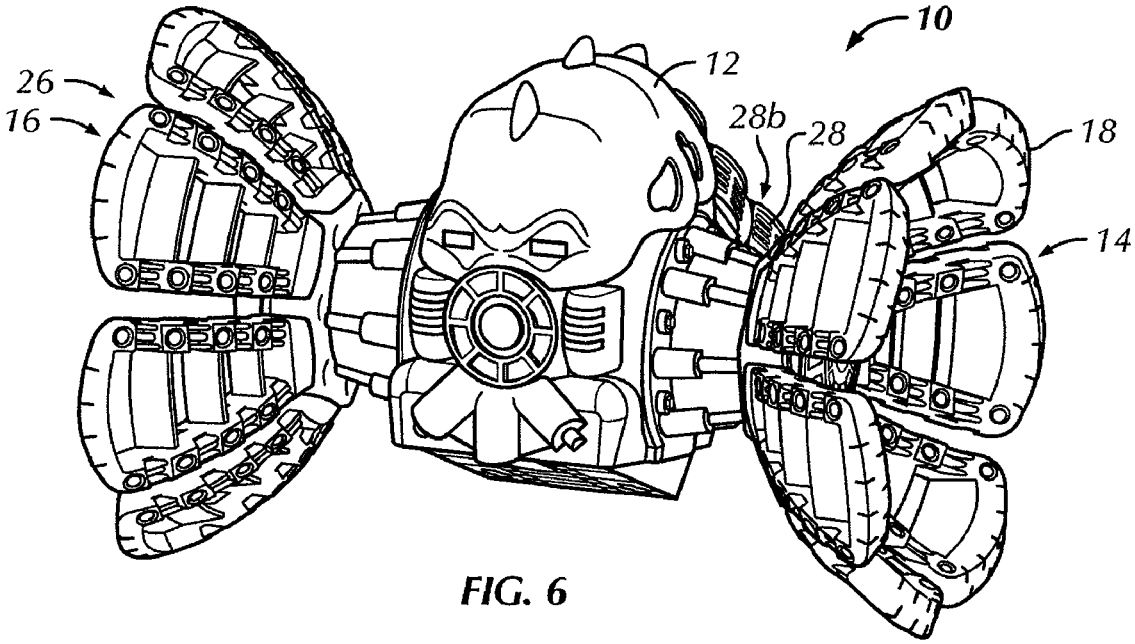
FIG. 6 is a top front right perspective view of the toy vehicle of FIG. 4.
Figure 7:
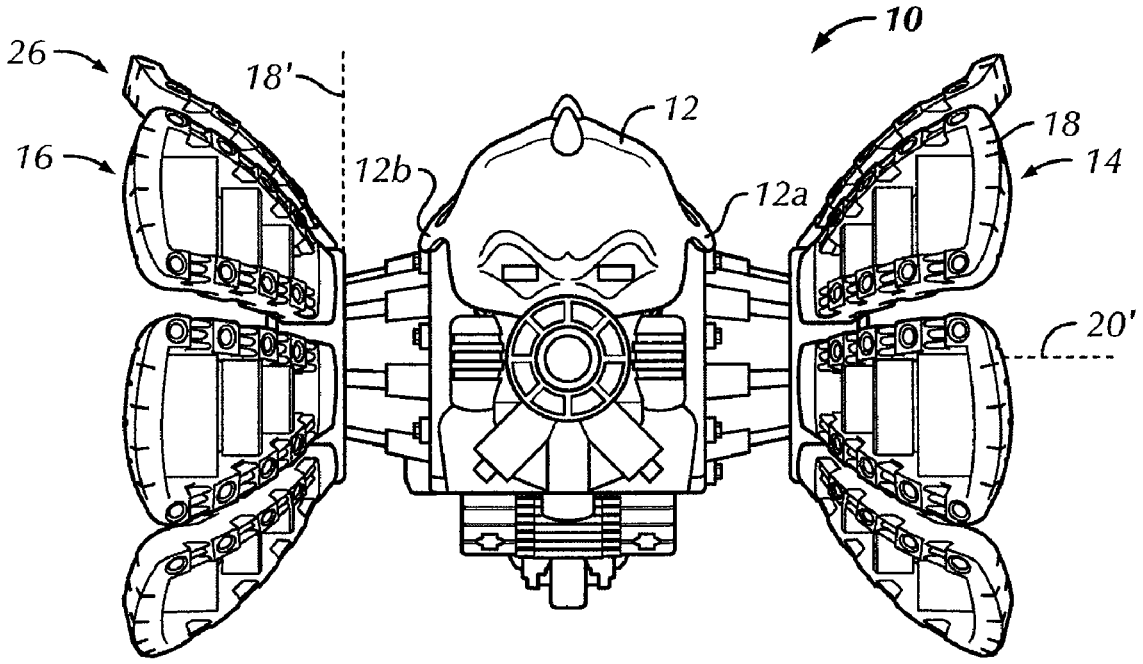
FIG. 7 is a front perspective view of the toy vehicle of FIG. 1, the toy vehicle shown with a second wheel configuration.
Figure 8:
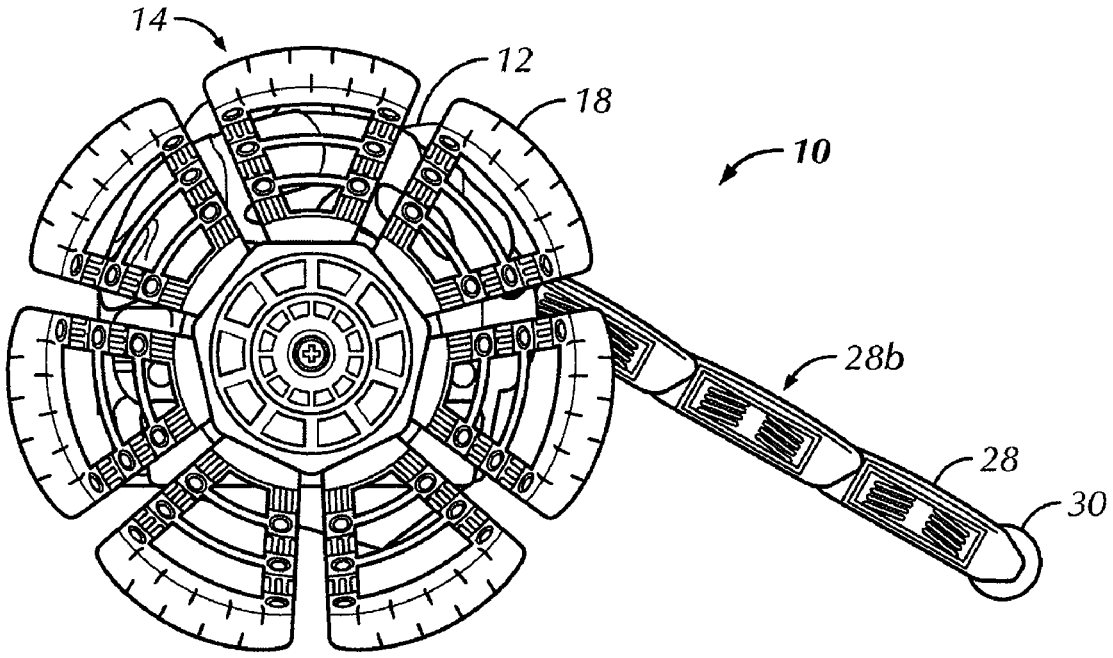
FIG. 8 is a right side perspective view of the toy vehicle of FIG. 7.

The vehicle 10 is configured in a way to be described in greater detail below to permit individual and separate manual angular repositioning of each of the vanes 18 of the first and second wheels 14 and 16 about the second vane axis 18' of the vane 18 between a first extreme rotational position of each vane 18 yielding a first, ball-like, preferably generally spherical configuration 24 seen in FIGS. 1-3 and a second, opposing, extreme rotational extreme position about 180° away from the first rotational position yielding a second configuration 26 seen in FIGS. 6-8 in which each wheel 14, 16 has a generally hemispheric configuration with a cupped interior and large open end formed by the interior of each hemispheric wheel 14, 16 facing outwardly from the outer housing 12 and the other wheel. In the first rotational configuration 24 of the vanes 18, the first and second wheels 14, 16 are generally cupped with open ends directed inwardly toward one another. In the second rotational configuration 26 of the vanes 18, the first and second wheels 14, 16 are generally cupped with the open ends directed outwardly away from one another. The vanes 18 are preferably curved along and across their length whereby the first and second wheels 14, 16 are generally hemispherical in the first and second rotational positions 24, 26.

Figure 4:
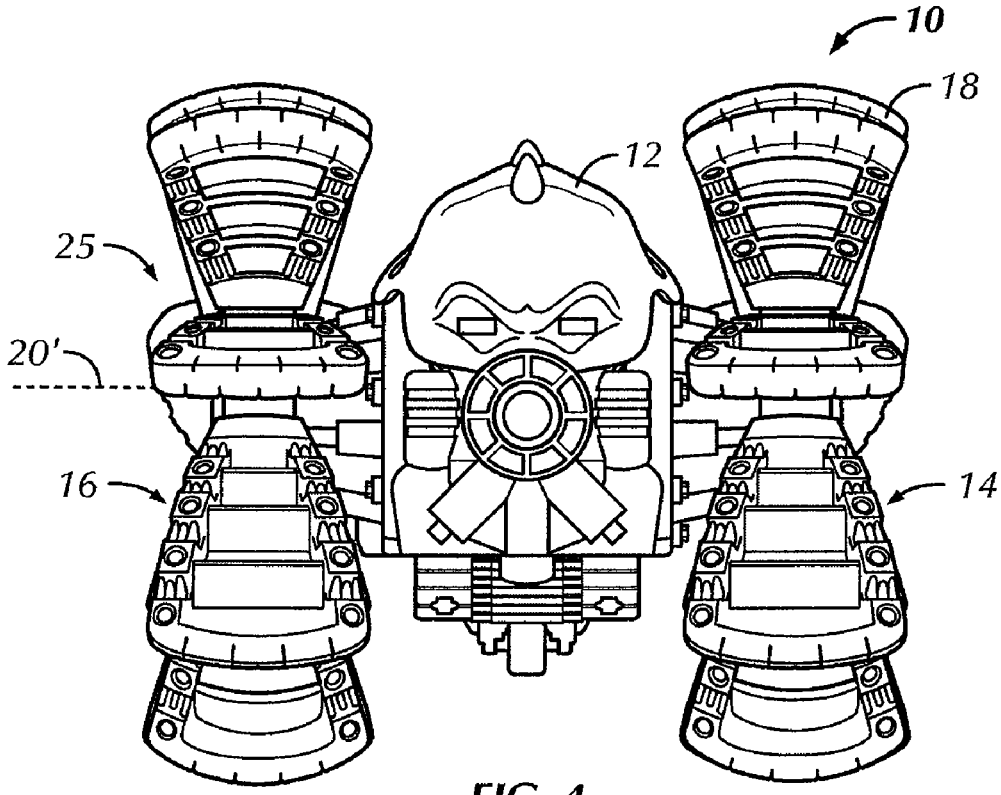
FIG. 4 is a front perspective view of the toy vehicle of FIG. 1, the toy vehicle shown with a third, paddle wheel configuration.
Figure 5:
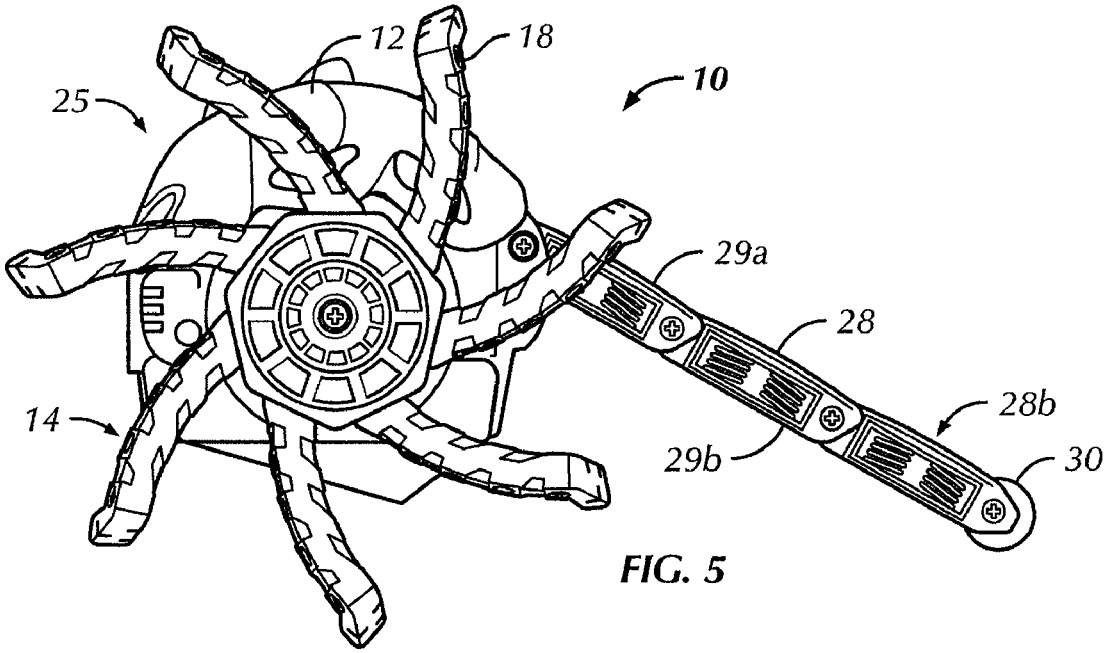
FIG. 5 is a right side perspective view of the toy vehicle of FIG. 4.

The vehicle 10 can further be configured in a third, "paddle wheel" configuration 25, as shown in FIGS. 4 and 5, in which the vanes 18 are oriented intermediate between the first and second configurations 24, 26, and preferably halfway in between the first and second configurations 24, 26, i.e. in the same directional orientation around the hub 20 about 90° away from each of the first and second rotational positions 24, 26 of the vane 18 about its second axis 18' between the first and second configurations 24, 26.

Figure 12:
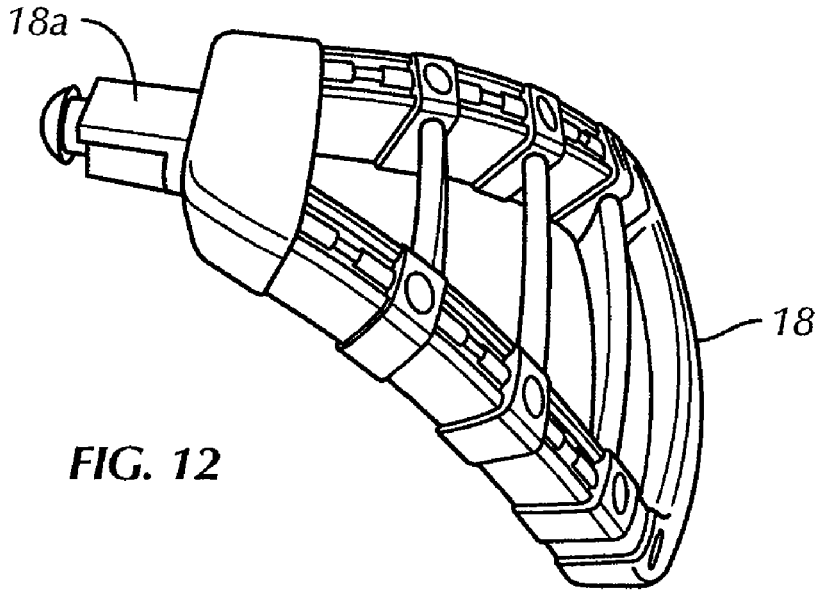
FIG. 12 is a perspective view of a vane of the toy vehicle in FIG. 1.

Referring now to FIG. 12, each vane 18 preferably includes a detent or post 18*a*, which is preferably square in cross-section, and which is used to manually position each vane 18 to place the toy vehicle 10 in any of the first, second, and third configurations 24, 26, 25. Specifically, the post 18*a* preferably includes an elastomeric sleeve (not shown) therearound. The post 18*a* and sleeve are pressed into a complementary hole (not shown) in the face 20*a* of the hub 20, such that the sleeve functions to retain the vane 18 in a particular, desired configuration, but, due to its resilience, also allows the vane 18 to be rotated within the hole when manipulated by a user. In this way, the post 18*a*, sleeve, and hole effectively function in a detent-like manner to retain the vane 18 in a desired configuration but also allow the vane 18 to be rotated into a different configuration, if desired. Because the post 18*a* preferably has a square profile, four vane positions are possible, i.e., 0°, 90°, 180°, and 270°. For definitional purposes 0° is the inward facing, spherical configuration 24 of FIGS. 1-3; 90° is the third rotational position providing the third, "paddle wheel" configuration 25 of FIGS. 4-5; and 270° is the second rotational position providing the second, outwardly cupped wheel configuration 26 of FIGS. 6-8. While this is preferred, it is within the spirit and scope of the present invention that the post 18*a* have different profiles including but not limited to polygonal cross-sections with more or less than four sides to enable more or fewer different orientations of the vanes 18, respectively.

With the above-described configuration, when the user desires to reconfigure the toy vehicle 10, the user must individually rotate each of the vanes 18 to achieve the desired configuration. It is noted that, while only three configurations 24, 25, 26 are specifically described herein, any number of configurations can be achieved by simply rotating different vanes 18 to different orientations with respect to one another, rather than orienting all of the vanes 18 to the same position. While the above-described post 18, sleeve, and hole configuration is preferred, it is within the spirit and scope of the present invention that the vanes 18 be selectively retained/rotated in a different manner, including, but not limited to, mirror cruciform, or star or polygonal shaped hole and post configurations or a spring-biased detent mechanism with multiple contacted detent surfaces. Moreover, while it is preferred that the vanes 18 be retained in the hub 20 while manually rotated by the provision of a pliant post 18*a* and hole, it is also part of the invention that neither the post 18*a* nor the hole be sufficiently pliant to permit rotation of the vane 18 while connected with the hub 20, and that manual angular repositioning includes permitting manual removal and reinsertion of the post in the hole in any angular orientation permitted by the post and hole configurations.

While it is preferred that the post 18*a* be part of the vane 18 and the hole be in the hub 20, the invention includes a reversal of positions with the posts projecting generally radially outwardly from the hubs 20 and the vanes 18 being provided with the holes.

The vanes 18 can be made from any suitable material. If desired, the vanes 18 can each be formed from a foam polymer molded to a solid support shaft. Such foamed polymer vanes would not only be resiliently flexible themselves, providing considerable cushioning to the outer housing 12, but also would provide sufficient buoyancy to the vehicle 10 to enable it to be driven in water.

Referring again to FIGS. 1-8, in any of the first, second, and third configurations 24, 26, 25, a preferably articulated tail 28 bearing a freely rotating reaction wheel 30 is extended transversely from the outer housing 12 preferably in a generally or nearly tangential direction with respect to the wheels 14, 16. The tail 28 has at least a first end 27*a* pivotally connected to the outer housing 12 and an oppositely disposed, free second end 27*b* proximate the wheel 30. The tail 28 is formed by at least two articulated segments, such that a first segment 29*a* is rotatably coupled to the housing 12 and at least a second segment 29*b* is rotatably coupled to the first segment 29*a*. Preferably, the tail 28 moves between a retracted position 28*a* and an extended position 28*b* through centripetal force caused by and/or reaction to rotation of the wheels 14, 16 and functions to stabilize operation of the vehicle 10 by inhibiting rotation of the outer housing 12 with rotation of the wheels 14, 16 in a forward propulsion direction. The tail 28 is preferably flexible, such that the tail 28, in the retracted position 28*a*, is generally wrapped at least partially around the housing 12 and, in the extended position 28*b*, extends outwardly from the housing 12 so that at least the second end is spaced from the housing 12 beyond the circumferences of the wheels 14, 16. Further, in the retracted position 28*a*, the tail 28 is disposed between open ends of the first and second wheels 14, 16 even with the vanes 18 in the first position 24.

Figure 9:
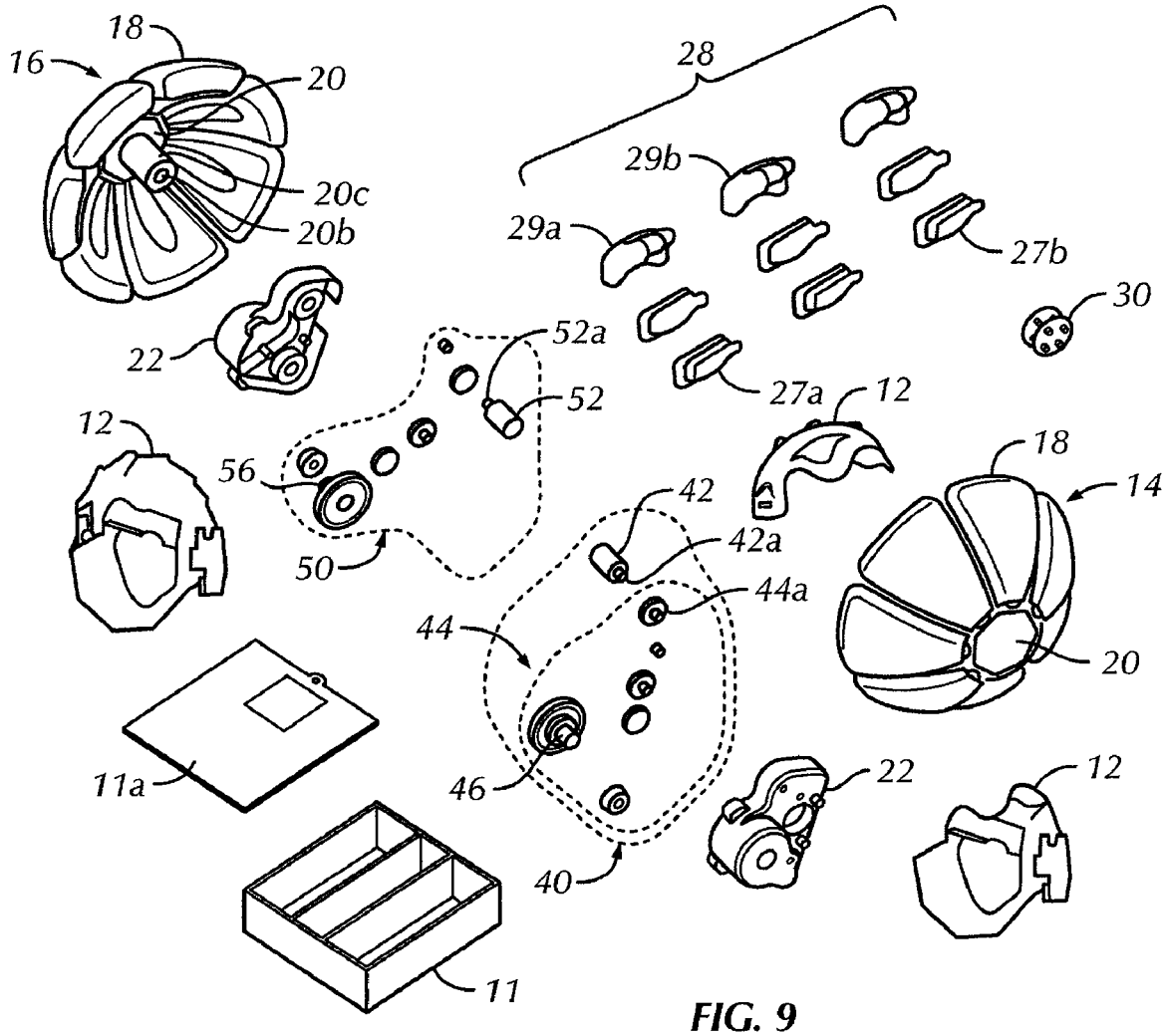
FIG. 9 is an exploded perspective view of the toy vehicle of FIG. 1.
Figure 10:
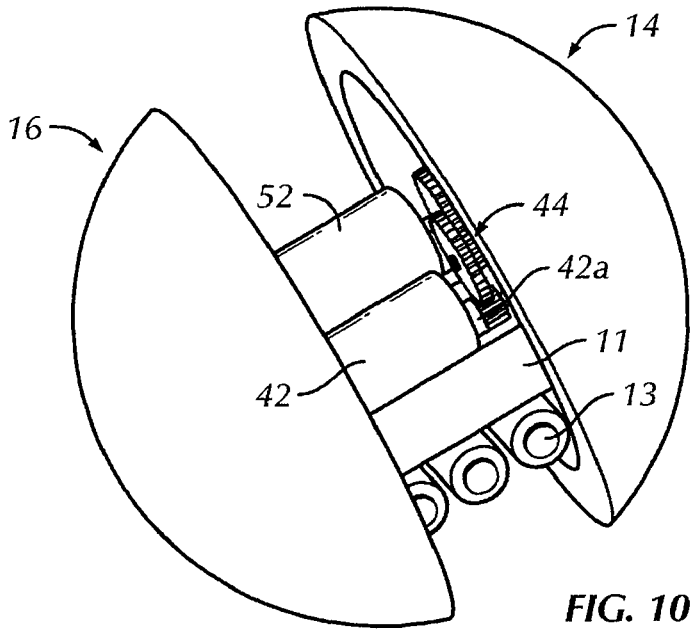
FIG. 10 is a perspective view of the toy vehicle of FIG. 1, the wheels being depicted as hemispheres rather than individual vanes for the sake of simplicity and an outer housing being removed to expose the drive mechanism therein.
Figure 11:
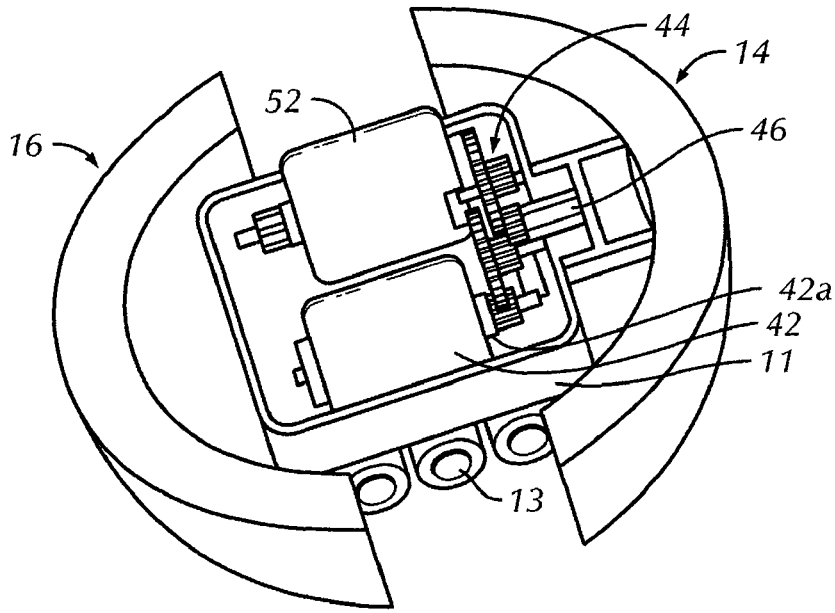
FIG. 11 is a cross-sectional perspective view of the toy vehicle of FIG. 10 taken generally along a central plane of the toy vehicle.

Referring to FIGS. 9-11, a preferred drive mechanism for driving the wheels 14, 16 is shown. It is initially noted that, for the sake of simplicity, the wheels 14, 16 are shown in FIGS. 10-12 as hemispheres and not as individual vanes. The drive mechanism includes first and second drive trains indicated generally at 40, 50, respectively, driven by first and second motors 42, 52, respectively, disposed within a gear housing 22, which is disposed within the outer housing 12. Preferably, the first drive train 40 drives the first wheel 14, and the second drive train 50 drives the second wheel 16 independently of the first drive train 40 and first wheel 14. It is noted that the first and second drive trains 40, 50 are essentially identical; therefore, only the first drive train 40 will be specifically described below.

The first motor 42 is actuated to rotate a first output shaft 42*a* with a first pinion 44*a*. The first pinion 44*a* is the first gear of a first reduction gear train 44 that drivingly couples the first motor 42 to the first wheel 14. The first reduction gear train 44, depicted in detail in FIGS. 9-11, includes a plurality of intermeshed gears, which are not individually described herein. The first reduction gear train 44 ultimately rotates a post 46 disposed drivingly connected with the first wheel 14. Preferably, the post 46 is disposed within a complementarily keyed hole 20*b* within a tube 20*c* of the hub 20 extending inwardly toward a center of the toy vehicle 10. In this way, the post 46 and hub 20 are rotatably coupled by keying to drivingly couple the first motor 42 with the first wheel 14. In this way, the first and second wheels 14, 16 are individually driven separately and independently by the first and second motors 42, 52, respectively, so that the toy vehicle 10 can be driven forward or backward by actuating the first and second motors 42, 52 in the same direction at generally the same speed, or turned by actuating the first and second motors 42, 52 in different directions or in the same direction at different speeds.

While the above-described drive mechanism configuration is preferred, it is within the spirit and scope of the present invention that other drive mechanism configurations be used, provided the alternate drive mechanism configuration functions to cause movement of the first and second wheels 14, 16 of the toy vehicle 10. For instance, a single motor and a drive train having a generally convention throw-out gear could be used. In this way, when the motor is driven in a first direction, both wheels rotate together in one direction (i.e., a forward motion of the toy vehicle), and, when the motor is driven in a second direction, the wheel on one side of the toy vehicle is caused to rotate in one direction, while the wheel on the other side of the toy vehicle, through operation of the throw-out gear, is caused to either rotate in an opposite direction or to stop motion, thereby allowing the toy vehicle to be turned.

Figure 13:
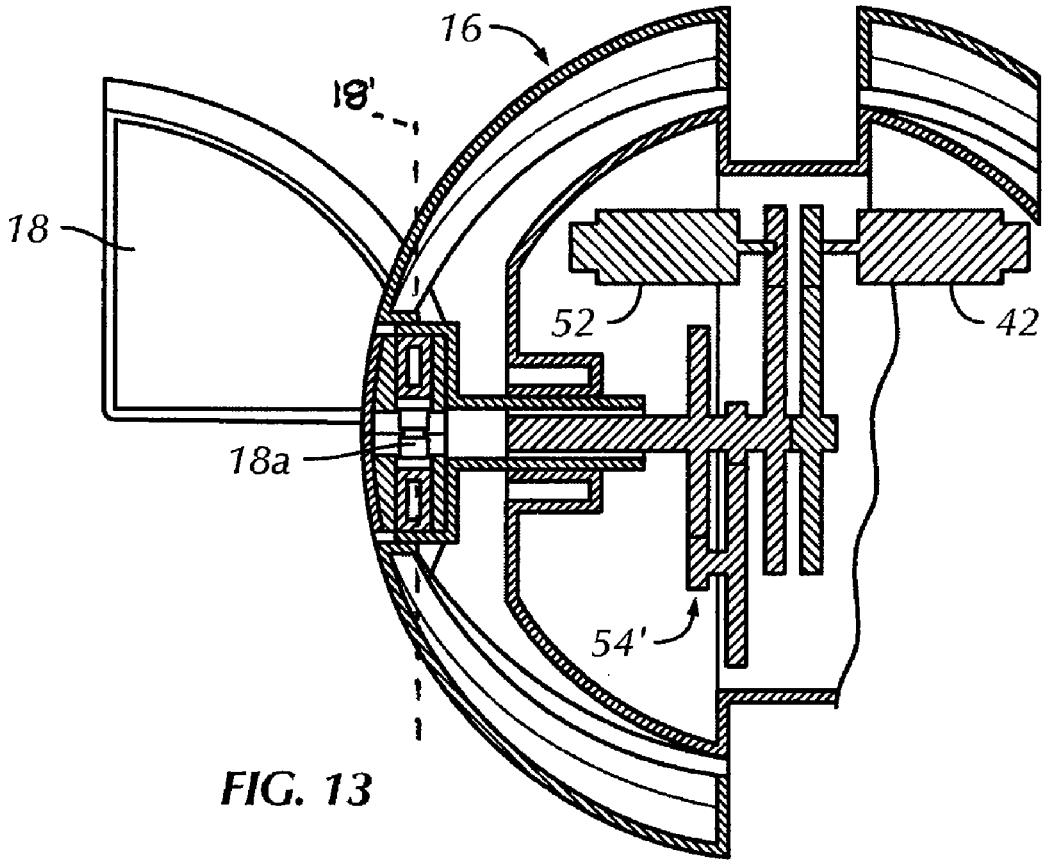
FIG. 13 is a cross-sectional plan view of the toy vehicle of FIG. 1 taken generally along a central plane of the toy vehicle, the toy vehicle having an alternate drive mechanism, the toy vehicle being shown with one vane turned outwardly.
Figure 14:
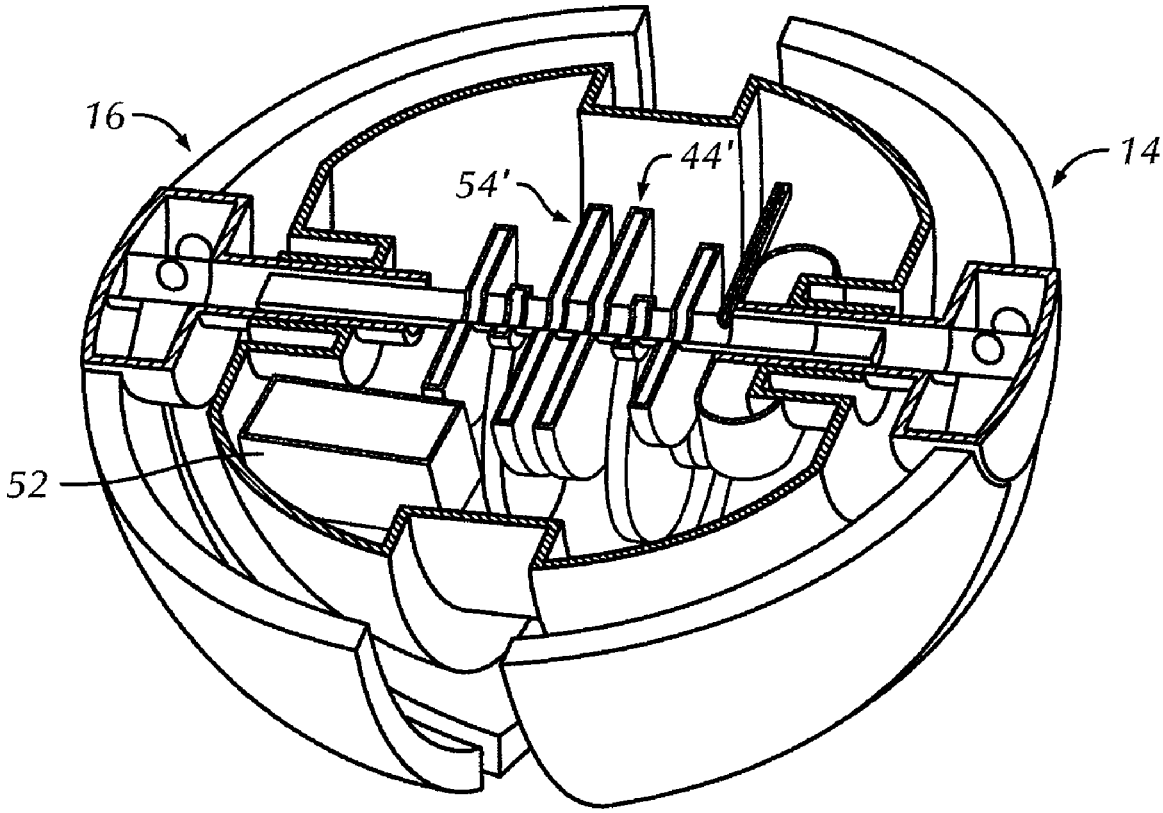
FIG. 14 is a cross-sectional perspective view of the toy vehicle of FIG. 13 taken generally along a central plane of the toy vehicle.

Referring now to FIGS. 13 and 14, an alternative drive mechanism is shown. The alternative drive mechanism is largely similar to the above-described drive mechanism except that first and second reduction gear trains 44', 54' are slightly differently configured and situated differently within the toy vehicle 10. The function of the first and second drive trains 44', 54' are largely similar to that described above, in that the first and second drive trains 44', 54' drivingly couple the first and second motors 42, 52 to the first and second wheels 14, 16, respectively. Therefore, no further description of the first and second drive trains 44', 54' is included herein.

Figure 15:
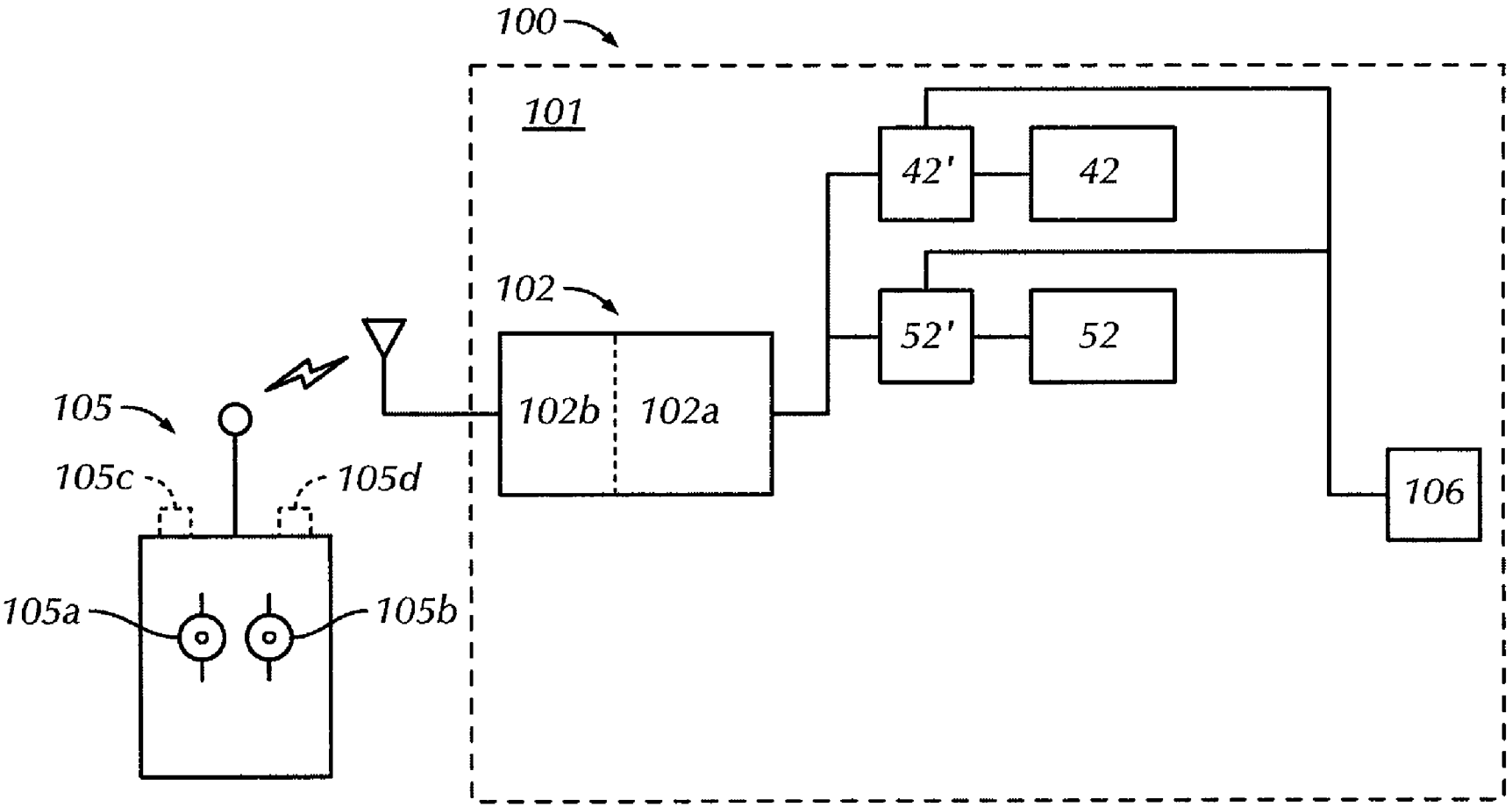
FIG. 15 is a schematic diagram of a wireless remote control transmitter 105 and an on-board control unit 101 of the toy vehicle shown in FIG. 1.

As shown in FIG. 15, the toy vehicle 10 of the above described embodiment is preferably configured to be operably controlled by a wireless remote control transmitter 105. Preferably the toy vehicle 10 is controlled via radio (wireless) signals from the wireless remote control transmitter 105. However, other types of controllers may be used including other types of wireless controllers (e.g., infrared, ultrasonic and/or voice-activated controllers) and even wired controllers and the like. Preferably, the on-board control unit 100 is operatively coupled with the first and second motors 42, 52 and configured to receive and process control signals transmitted from the remote source 105 spaced from the toy vehicle 10 to remotely control operation of the first and second motors 42, 52.

The toy vehicle 10 is provided with a control unit 100 mounted on a conventional circuit board 101. The control unit 100 includes a controller 102 preferably having a wireless signal receiver 102*b* and a microprocessor 102*a* plus any necessary related elements such as memory. The motors 42 and 52 are reversible and are controlled by the microprocessor 102*a* through motor control subcircuits 42' and 52' which, under control of microprocessor 102*a*, selectively couples each motor 42, 52 with an electric power supply 106 (such as one or more disposable or rechargeable batteries 13).

In operation, the wireless remote control transmitter 105 sends signals to the toy vehicle 10 that are received by the wireless signal receiver 102*b*. The wireless signal receiver 102*b* is in communication with and is operably connected motors 42, 52 through the microprocessor 102*b* for controlling the toy vehicle's 10 speed and maneuverability. Operation of the propulsion drive motors 42, 52 serve to propel and steer the toy vehicle's 10 through separate and individual control of each motor 42, 52. The drive motors 42, 52 and control unit 100 components are conventional devices readily known in the art and a detailed description of their structure and operation is not necessary for a complete understanding of the present invention. However, exemplary drive motors can include brushless electric motors, preferably providing a minimum of 1,360 revolutions per minute per volt.

In use, the toy vehicle 10 is driven on a surface by rotation in either rotational direction of the first and/or second wheels 14, 16. The toy vehicle 10 can be transformed by manually rotating or otherwise repositioning the vanes 18 of the first and second wheels 14, 16 about the second axes 18' between the first position 24 in which the toy vehicle 10 is generally spherical in shape and the third position 26 in which the entire central housing 12 is exposed. Further, the tail 28 is able to be positioned in the extended position 28*b* or wrapped partially around the central housing 12 in the retracted position 28*a* with rotation of the outer housing 12 caused by driving of the first and second wheels 14, 16 in forward or reverse direction, respectively. The vanes 18 of the toy vehicle 10 can also be configured in the intermediate position 25 (FIG. 4), so that the first and second wheels 14, 16 resemble paddle wheels, or any other rotational position between the first and second positions 24, 26. While these three configurations 24, 25, 26 of the wheels 14, 16 provided by uniform angular orientation of all of the vanes 18 of both wheels 14, 16 are preferred, it will be appreciated that the individual vanes 18 of the individual wheels 14, 16 can be manually set in virtually any angular orientation permitted by the vane 18/hub 20 coupling thereby permitting the angular orientations of the vanes 18 of each wheel 14, 16 to be mixed, wheel to wheel and in each wheel, thereby permitting more fanciful wheel design. For example, four of the vanes 18 can be arranged in 0° or 180° orientations while the remaining vanes 18 can be alternated among the four in 90° orientations. Of course, the provision of an even number of vanes 18 per wheel 14, 16 would permit symmetric alterations of angular orientations of vanes 18 on a given wheel.

If provided with buoyant vanes 18 and tail 28, the toy vehicle 10, with the chassis/housing 12 otherwise sealed, can then be driven on the surface of water. Although intended to be driven on water when in the intermediate position 25, the toy vehicle 10 can also be driven on dry land with the vanes 18 in any position. Moreover, it is contemplated that the toy vehicle 10 can be driven on water with the vanes 18 in any position including but not limited to either of the first and second positions 24, 26, though not as effectively as the third position 25.

While remote control of the toy vehicle is preferred, it will be appreciated that the toy vehicle can be factory preprogrammed to perform a predetermined movement or series of movements or configured to be selectively programmed by a user to create such predetermined movement(s). Alternatively or in addition, the toy vehicle can be equipped with sensors, e.g., switches, proximity detectors, etc., that will control the toy vehicle to turn away from or reverse itself automatically from whatever direction it was moving in if or when an obstacle is contacted or otherwise sensed.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claim.

I claim:

1. A toy vehicle including a central housing having first and second oppositely disposed sides, a first wheel rotatably mounted on the first side of the housing and a second wheel rotatably mounted on the second side of the housing, each of the first and second wheels having a central hub, each hub having a center disposed along a common first axis of rotation, a plurality of vanes attached to the hub and forming the first and second wheels, an end of each vane distal to the hub forming an outermost circumferential surface portion of one of the first and second wheels most distal to the first axis in all configuration of the first and second wheels, wherein each vane is individually and separately manually angularly repositionable about a second axis of rotation, each second axis extending from an end of the vane proximal to the hub transversely away from the first axis.

2. The toy vehicle of claim 1, further comprising a tail movably engaged with the housing, the tail having at least a first end and an oppositely disposed, free second end, the tail being movable between a retracted position and an extended position.

3. The toy vehicle of claim 2, wherein the first end of the tail is rotatably attached to the housing.

4. The toy vehicle of claim 2, wherein the tail is buoyant in water.

5. The toy vehicle of claim 2, wherein the tail includes at least one tail wheel proximate the second end for contacting a surface in at least the extended position of the tail.

6. The toy vehicle of claim 1, wherein the vanes are curved, such that, in a first rotational position of the vanes, the first and second wheels are generally cupped with open ends directed inwardly toward one another and, in a second rotational position of the vanes, the first and second wheels are generally cupped with the open ends directed outwardly away from one another.

7. The toy vehicle of claim 6, wherein the first and second wheels are generally hemispherical in the first and second rotational positions.

8. The toy vehicle of claim 6, wherein the vanes are selectively rotatable to at least one intermediate rotational position between a first rotational position and a second rotational position.

9. The toy vehicle of claim 8, wherein the tail is flexible, such that the tail, in the retracted position, is generally wrapped at least partially around the housing and, in the extended position, extends outwardly from the housing so that at least the second end is spaced from the housing.

10. The toy vehicle of claim 9, wherein the tail is formed by at least two articulated segments, such that a first segment is rotatably coupled to the housing and at least a second segment is rotatably coupled to the first segment.

11. The toy vehicle of claim 10, wherein the tail, in the retracted position, is disposed between open ends of the first and second wheels with the vanes in the first position.

12. The transformable toy vehicle of claim 8, wherein in the intermediate configuration the wheels are converted into paddle wheels with the vanes rotated about ninety degrees from each of the first and second rotational positions.

13. The toy vehicle of claim 1, further comprising at least a first motor operatively coupled to at least the first wheel to drive at least the first wheel.

14. The toy vehicle of claim 13, further comprising at least a second motor operatively coupled to at least the second wheel to drive at least the second wheel independently of the first wheel.

15. The toy vehicle of claim 1, wherein each vane is coupled to the hub through a rotatable detent coupling having a non-circular cross section to enable each vane to be selectively manually positioned in any of a plurality of discrete angular positions about the second axis.

16. The toy vehicle of claim 1, further comprising an control unit operatively coupled with the first and second motors and configured to receive and process control signals transmitted from a remote source spaced from the toy vehicle to remotely control operation of the first and second motors.

17. The toy vehicle of claim 1 wherein each second axis extends at least generally radially away from the first axis of rotation.

* * * * *